US007739888B2

(12) United States Patent
Sciacca

(10) Patent No.: US 7,739,888 B2
(45) Date of Patent: Jun. 22, 2010

(54) METHOD AND EQUIPMENT TO CHANGE THE KNITTING DENSITY IN THE PRODUCTION OF WARP FABRICS AND TUBULAR ARTICLES BY RASCHEL LOOM AND OBTAINED PRODUCTS

(75) Inventor: Franco Sciacca, Cassina Rizzardi (IT)

(73) Assignee: Santoni S.p.A., Brescia (IT)

( * ) Notice: Subject to any disclaimer, the term of this patent is extended or adjusted under 35 U.S.C. 154(b) by 502 days.

(21) Appl. No.: 10/580,349

(22) PCT Filed: Nov. 23, 2004

(86) PCT No.: PCT/IT2004/000645

§ 371 (c)(1),
(2), (4) Date: Mar. 12, 2007

(87) PCT Pub. No.: WO2005/052236

PCT Pub. Date: Jun. 9, 2005

(65) Prior Publication Data

US 2007/0266739 A1 Nov. 22, 2007

(30) Foreign Application Priority Data

Nov. 25, 2003 (IT) ..... CO2003A0019

(51) Int. Cl.
*D04B 23/00* (2006.01)

(52) U.S. Cl. ..... 66/208; 66/204; 66/81

(58) Field of Classification Search ..... 66/8, 66/23, 28, 81, 71, 69
See application file for complete search history.

(56) References Cited

U.S. PATENT DOCUMENTS

| | | | | |
|---|---|---|---|---|
| 3,566,621 | A | 3/1971 | Perrier | |
| 3,681,944 | A | 8/1972 | Peschl et al. | |
| 3,693,378 | A | 9/1972 | Nogues | |
| 4,270,368 | A * | 6/1981 | Ragoza et al. | 66/13 |

FOREIGN PATENT DOCUMENTS

| | | |
|---|---|---|
| DE | 28 43 264 A1 | 4/1980 |
| GB | 1 303 359 A | 1/1973 |

* cited by examiner

*Primary Examiner*—Danny Worrell
(74) *Attorney, Agent, or Firm*—Pearne & Gordon LLP

(57) ABSTRACT

The invention relates to a method and related equipment for manufacturing shaped fabrics or anatomically shaped tubular hosiery and knitwear items, obtained with Raschel looms having preferably two parallel needle beds and automatic latch needles. During the knitting process, by gradually varying the height of the needle bed and of the sinking plane lying above with respect to the needles sliding in the same bed, knitting density can also be suitably changed. As a consequence, concerned anatomic parts such as the bodice and ankles of a pair of tights or a stockings as well as the waist and sleeves of a sweater can be shaped with higher accuracy and effectiveness.

16 Claims, 2 Drawing Sheets

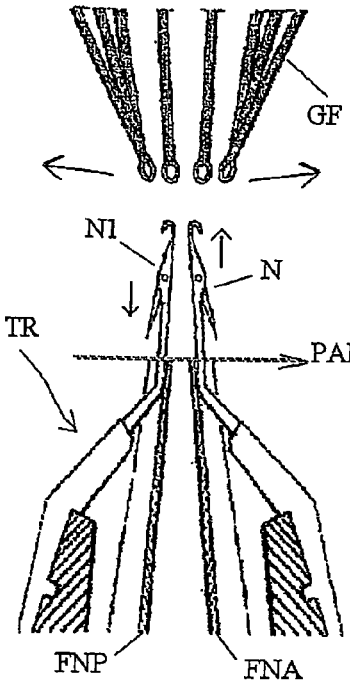
FIG. 1
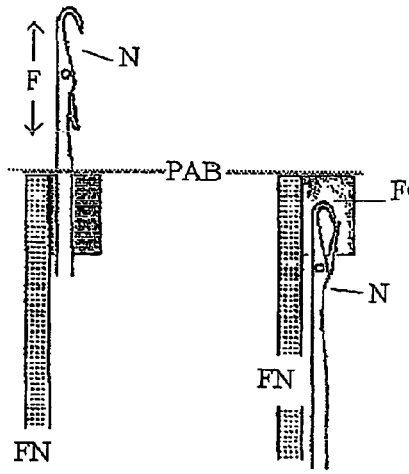
FIG. 2 FIG. 3
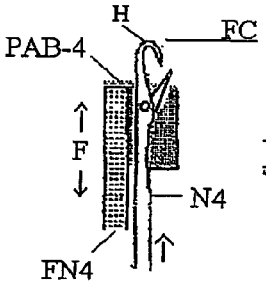
FIG. 4A
FIG.7
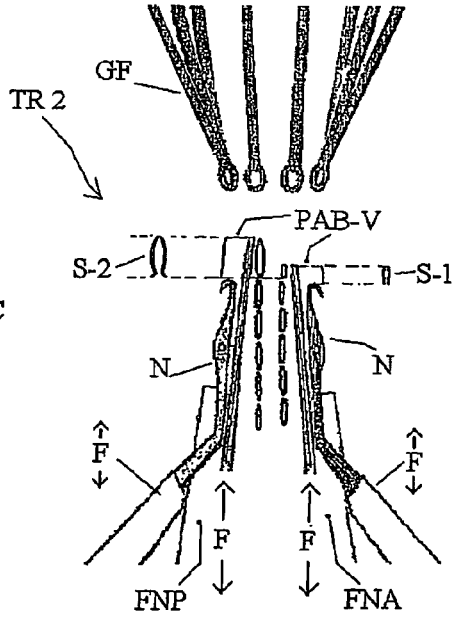
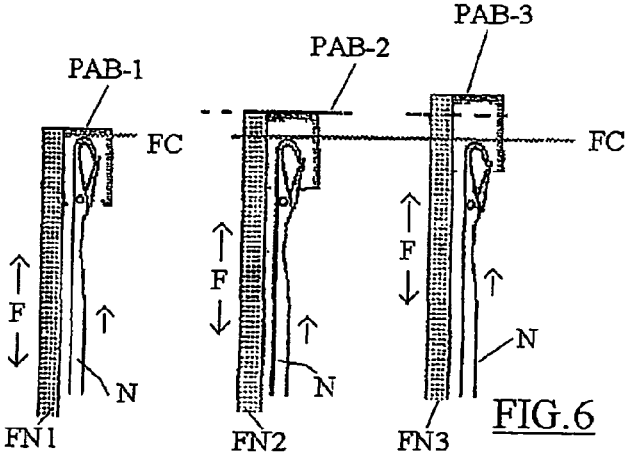
FIG. 4 FIG. 5 FIG.6

FIG. 9
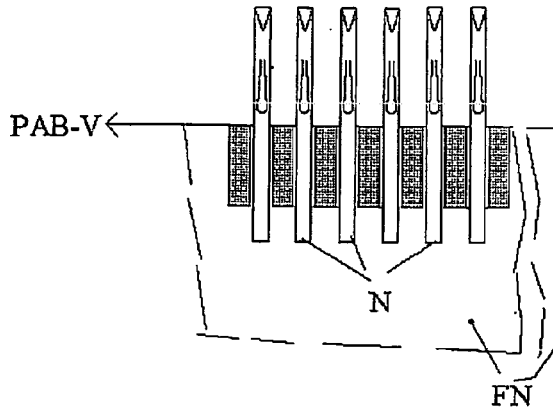
FIG.10
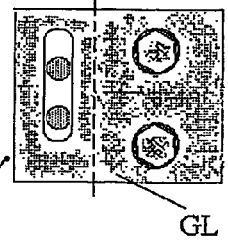
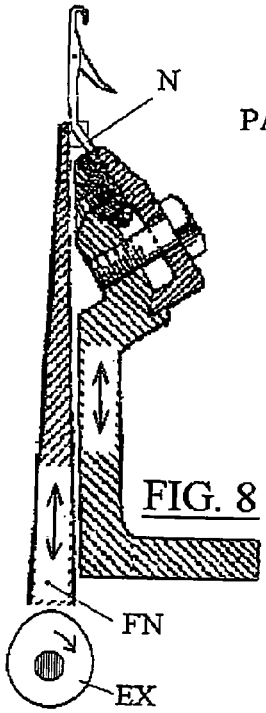
FIG. 8
FIG. 12
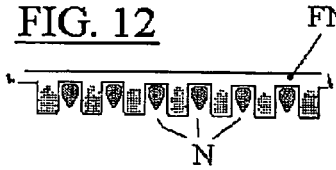
FIG. 11
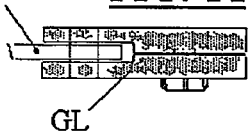
FIG.13
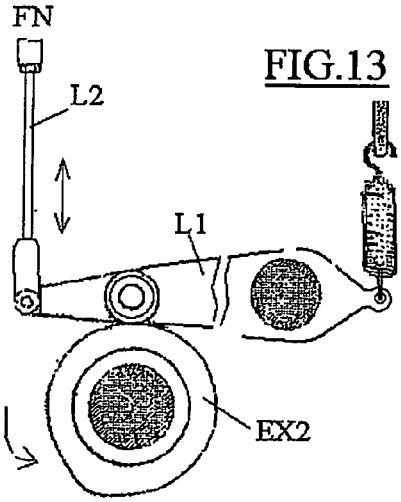
FIG.14
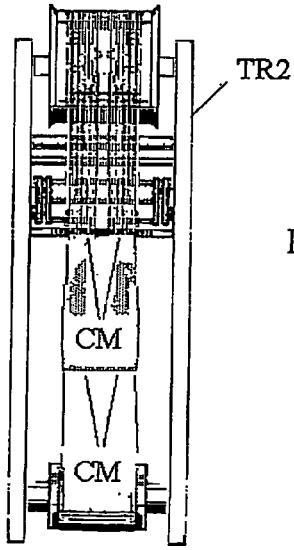
FIG.15
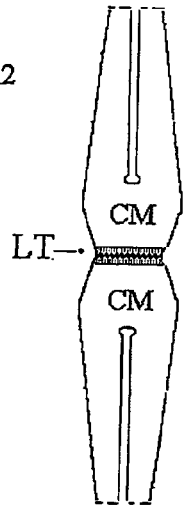

METHOD AND EQUIPMENT TO CHANGE THE KNITTING DENSITY IN THE PRODUCTION OF WARP FABRICS AND TUBULAR ARTICLES BY RASCHEL LOOM AND OBTAINED PRODUCTS

So-called Raschel looms having two basically vertical and parallel needle beds are used as a rule for a wide range of warp knitted fabrics.

Said looms are sometimes used also for manufacturing tubular hosiery and knitwear items with a manufacturing process partly corresponding to the one of traditional linear two-bed flat knitting machines.

Tubular items thus manufactured do not fully meet the requirements of current textile production, which privileges anatomically shaped tubular or seamless manufactured items, more comfortable and elegant.

This is due to the fact that in the aforesaid Raschel looms knitting density is varied empirically by changing both the tension of yarns fed to the needles and the pulling strength of items during the manufacturing stage.

This method, which is both imperfect and limited, simply exploits the intrinsic elasticity of the various yarns together with the general elasticity of the fabric during the manufacturing stage.

In practice, the aforesaid looms are not provided with a reliable mechanical-textile device for controlling and adjusting in a continuous and precise way the knitting density during the knitting stage. The negative consequences of such limitation affect tubular items thus manufactured, which are objectively imperfect as far as their anatomic shape is concerned and hardly reproducible and modifiable as far as size is concerned. In an example from the prior art, a Raschel loom, referred to with TR in FIG. 1, is provided with a front needle bed FNA and a rear needle bed FNP, which are parallel and basically vertical and house needles N-N1 moving alternately for taking up the yarns from oscillating yarn feeders GF so as to produce, together with the sinking plane PAB, common warp knitted "double-bed" fabrics or said tubular items.

During the manufacturing cycle needle N, housed slidingly in fixed bed FN, sinks from its maximum height in FIG. 2 to the lower or stroke-end position FC in FIG. 3, i.e. under the sinking plane PAB.

During the stroke of needle N needle bed FN does not move.

In other words, needles N-N1 in FIG. 1 follow a fixed and forced forward and backward (or up and down) way within two extreme definite positions in order to take up the yarn for obtaining the stitch on sinking plane PAB, i.e. on top of needle beds FN, usually fastened to the supporting frame of loom TR (not shown). Though seldom used, the production of tubular items with the aforesaid Raschel loom has some technical-textile problems due to the fact that the number of operating needles cannot be changed, whereas knitting density can be varied only to a small and imprecise extent.

For instance, when manufacturing very fine tights with jersey or stocking fabric, which therefore have an evident covering effect, the different nature of the anatomic parts involved therein should be taken into consideration, such as hips, glutei, thighs and ankles. Concerning this, it can be easily understood that in order to obtain a duly shaped manufactured item, different knitting densities depending on the anatomic parts involved therein are necessary, considering that ankle size is about one third of thigh size.

Thus, only a continuous and suitable variation of knitting density ensures that the manufactured items regularly adheres to the anatomic parts involved therein, which is an unavoidable need for so-called "medical" or therapeutic stockings, characterized by a higher and gradual fabric compression on feet, ankles and calves. Now, the present invention aims at eliminating or reducing lacks and limits as referred to above by proposing fabric, knitwear and hosiery items meeting more suitably the requirements of modern textile products with original economic, manufacturing, functional, aesthetical and commercial purposes.

Therefore, an aim of the invention consists in providing a method and related equipment for manufacturing, with two needle beds "tricot-Raschel-crochet" looms for link knitting, tubular knitwear and hosiery items among which dresses, sweaters and stockings, tights, bodices and the like having a differentiated elasticity and knitting density with a more accurate anatomic shape.

A further aim consists manufacturing traditional single-needle or double-needle bed warp knitted fabrics further characterized by a higher flexibility and accuracy in the variation of existing knitting densities, which can also be very different, or for new three-dimensional effects, i.e. also in relief.

An additional aim consists in manufacturing fabrics and warp knitted items characterized by courses or stitches having a structure corresponding to the one known as "tuck stitch" in the field of weft knitting.

Further aims will appear from the description, examples and accompanying drawings, per se or in combination with one another, beyond the final claims.

The characteristics of the invention and related advantages will be more evident from the following description of examples of embodiment shown in the accompanying figures, in which:

FIGS. 1-2-3 show a partial view of prior art warp loom TR provided with parallel beds FNA-FNP with sinking plane PAB lying above with latch needles N-N1 operating alternately from high position for taking up yarns from yarn feeders GF to low or stroke-end position of FIGS. 2-3;

FIGS. 4, 5, 6 show different operating positions of the needle bed, which depending on the various circumstances takes positions FN1, FN2, FN3 to which correspond the operating heights of sinking planes PAB-1, PAB-2, PAB-3 lying above;

FIG. 7 is a partial view of loom TR2 characterized by moving needle beds PNA-PNP whose vertical shift affects in this case directly and separately the length (and density) of stitches S-1, S-2 thus produced, due to corresponding variable sinking planes PAB-V;

FIG. 8 shows the combination of needles N, housed slidingly in the moving needle bed FN onto which acts cam EX, which according to the different embodiments can rotate with continuous or alternate movement. In FIG. 9 the aforesaid needle bed FN and corresponding needles N build a combination of reciprocally moving and sliding parts;

FIGS. 9, 10, 11, 12 show a front and a plan view of needle bed FN kept in position and sliding on the lateral ends by means of guides GL, which are in their turn fastened to the loom supporting frame, not shown;

FIG. 13 shows a simple device for controlling directly the height of needle bed FN. It is a known combination of mechanical parts for lifting and lowering directly needle bed FN depending on the desired knitting density;

FIG. 14 shows a schematic front view of loom TR2, intentionally extended so as to see tights CM produced continuously according to a repeatable minimum cycle: bodice-toe;

in FIG. 15 the different tights CM are produced according to an inverted operating cycle; toe-toe. LT refers to cutting line.

The description refers to a "tricot-Raschel-crochet" loom for warp knitting, equipped with two needle beds, and needles preferably of automatic type, i.e. with self-moving latch.

By the way, also hooked needles or pressure needles, compound needles and the like are however included in the teachings of the invention. From a general mechanical-textile point of view, the Raschel loom referred to is widely known to skilled technicians and does not require as such any specific description.

The invention can apply both to Raschel machines or looms (also known as "tricot" looms) having one or two parallel and vertical needle beds (i.e. whose needles slide vertically) and to Raschel machines or looms of "crochet" type, having one or two parallel and horizontal needle beds (i.e. whose needles slide horizontally).

Anyway, reference is made to U.S. Pat. No. 2,604,768 and to mentioned patents.

Raschel loom designed to produce the manufactured items according to the invention differs from known looms also in that it is equipped with a mechanical precision instrument for automatically adjusting the knitting density corresponding to the combination of one or more beds of needles moving with respect to needles housed therein during the knitting cycle, and of said needles.

The aforesaid needle beds according to the invention change or vary their position within sufficiently useful limits, preferably along the longitudinal axis with respect to their needles. The specific case is schematically shown in detail in FIGS. 4, 5, 6, where needle N, shown sectioned as completely lowered or at stroke end FC, always lies in the same position or at the same height.

The usual needle bed, already referred to with FN in FIGS. 2 and 3, varies in this case its position and takes the different positions referred to with FN1-FN2-FN3, or with arrows F. This vertical stroke also changes in a substantial way the distance between position FC of needle N and sinking plane PAB lying above, which with respect to the fixed position of FIG. 3 takes now variable positions PAB-1, PAB-2, PAB-3 of FIGS. 4, 5, 6. The moving needle bed according to the present invention enables to change the vertical position or height of the sinking plane lying above, which is also gradually moving, thus obtaining several advantages.

FIG. 7 shows a sectioned view of a detail of Raschel loom TR2, which differs at first sight from the usual loom TR of FIG. 1 in that the moving beds housing the needles enable to vary the density of manufactured fabric depending on the position of said needles.

This results is a suitable anatomic shape of the aforesaid tubular items or new effects—which can also be very contrasting—of the different knitting densities in the same item or fabric (very narrow and very broad knitting), together with courses of undulating or three-dimensional knitted fabric due to exceeding knitted fabric of a fabric portion with respect to other fabric portions.

Sinking plane PAB, previously fixed, becomes a moving and variable plane referred to as PAB-V in FIG. 7, and therefore every needle bed FNA-FNP can take part, if necessary, in the production of stitches having different and variable densities such as S-1 and S-2.

Moreover, the additional combination of needle N4 and needle bed FN4 in FIG. 4A enables to change also the amount and type of knitting structure of the knitted fabric produced in every needle bed.

As a matter of fact, by further lowering needle bed FN4 in FIG. 4A, hook or jack H of needle N4, though keeping its stroke FC (or minimum descent) unchanged, lies anyway above sinking plane PAB-4, to a sufficient extent so as to prevent the latter from producing the new stitch, i.e. from discharging the previous stitch. Therefore, in the various useful and efficient positions above said plane PAB-4, the latch of said needle N4 can be either open, half-open or closed; anyway, the temporary absence of sinking plane PAB-4, which lies too low with respect to lower stroke of needle N4, prevents stitch discharge, thus interrupting the knitting process.

This technique has interesting prospects and advantages from a textile point of view, both because the knitting process can be interrupted intentionally in every needle bed, and because the same yarn can be fed, if needed, at least two consecutive times to the same needle, which will produce a stitch using two yarns, an important result for reinforced knitted areas.

Moreover, by suitably coordinating the pulling strength of manufactured knitted fabric and the interruption of the knitting process, new three-dimensional knitting effects can be obtained together with transparent effects and a higher "non-run" degree of the manufactured item, the latter being a favorable feature also for technical fabrics. In general, traditional Raschel looms are particularly bulky and firm, often too large since they are on one side large-sized and heavy, whereas on the other side they have to reduce or damp continuous vibrations due to sometimes impressive operating speeds.

From an economic point of view, the invention prefers small-sized looms equipped with needle beds for producing single manufactured items or manufactured items in pairs.

This option highly simplifies design, manufacturing, investment and managing costs for these looms.

Considering the specific nature of envisaged production, the loom referred to is quite "lighter" and relatively modified with respect to traditional looms, with obvious advantages as far as initial costs and managing costs are concerned.

As far as the technical aspect involving the moving nature of the needle bed referred to is concerned, i.e. its longitudinal stroke in this case, known means commonly used in the industrial field in similar circumstances are provided for to this purpose, considering the size of said needle beds.

In a simple and cheap embodiment of the invention, needle bed FN in FIGS. 9 and 12 is kept in its operating position on its ends by suitable lateral guides GL in FIGS. 10 and 11, appropriately fastened to the main frame of Raschel loom. Against the lower part of said needle bed FN acts at least a cam EX schematically shown in FIG. 8, whose continuous or intermittent rotation engages and lifts the needle bed lying above. Descent occurs by gravity or by means of return springs.

In a different embodiment, said needle bed FN is functionally and structurally connected to a simple mechanical lifting and lowering device, schematically shown in FIG. 13. made up of usual mechanical elements such as cam EX2 engaging horizontal lever L1, which controls in its turn vertical lever L2 connected directly to needle bed FN lying above. More generally, for needle bed shifts known combinations are used, made up of cams, levers, connecting rods and cranks, traction springs, return springs, compression springs, guides or rectified sliding planes, bearings, slots and guiding pins inserted therein.

Known mechanical parts and means in various pushing and/or traction combinations, usually connected to general machine drive, or equipped with their own drive actuated by electric motors in general, brushless motors, stepless motors, linear motors, D.C. motors and the like connected to pushing, traction, torsion elements or means, with continuous, cyclical, controlled, gradual, micrometric, etc. movement, can be used.

An indirect example is the longitudinal shift obtained automatically with the needle cylinder or bed and/or its stitch cams in hosiery machines for graduating the knitting density depending on the various anatomic parts. Anyhow, it should be pointed out that the stroke of the aforesaid needle bed, though depending on its gauge (needles per inch or equivalents), remains a fractional value below a few millimeters, unless intentionally extreme density effects or transparent effects are desired, which are also possible according to the invention. The great flexibility of the invention enables to change also in a substantial way the shape and functions of at least a part of current production of fabrics, hosiery and warp knitted items with results and effects as described, shown and claimed.

Though necessarily limited, the present invention points out to skilled technicians further innovations, falling anyhow within the framework of the invention.

The invention claimed is:

1. A method for producing textile items with "tricot-Raschel-crochet" linear looms (TR2) for warp knitting, having at least a first bed (FNA) of needles (N, N1), comprising the step of manufacturing at least a textile item (CM), characterized in that it comprises the step of moving at least said first needle bed (FNA) during said step of manufacturing said textile item (CM), said needle bed (FNA) moving in order to vary the knitting density by varying the height of the sinking plane (PAB) with respect to the needles (N) sliding in the same bed (FNA).

2. The method according to claim 1, characterized in that it is executed on a machine (TR2) having further a second needle bed (FNP) and in that it further comprises the step of moving said second needle bed (FNP) during said step of manufacturing said textile item (CM).

3. The method according to claim 2, characterized in that said needle beds (FNA, FNP) can move parallel to a stroke of the corresponding needles (N).

4. The method according to claim 1, characterized in that said needle beds (FNA, FNP) can move in order to vary the knitting density by varying the height of the sinking plane (PAB) with respect to the needles (N) sliding in the same beds (FNA, FNP).

5. The method according to claim 1, characterized in that the needles (N) operate between two fixed, definite, alternate extreme positions.

6. The method according to claim 1, characterized in that it comprises the step of shifting at least one of said needle beds (FNA, FNP) so that the corresponding sinking plane of the needle bed (FNA, FNP) lies below an extreme lower position of the needles (N), so as to interrupt knitting temporarily and modify the structure of said knitted fabric.

7. The method according to claim 6, characterized in that it comprises the step of lifting again the needles (N), which previously could not produce new knitted fabric, to their operating position so as to be fed a second time with the same yarn.

8. A "tricot-Raschel-crochet" linear loom for warp knitting, comprising at least a first needle bed (FNA), characterized in that at least said first needle bed (FNA) is mounted movingly onto the loom and in that it further comprises means (GL, EX, EX2, L1, L2) for moving selectively said first needle bed (FNA) during the operation of the linear loom (TR2).

9. The loom according to claim 8, characterized in that it further comprises a second needle bed (FNP).

10. The loom according to claim 9, characterized in that said second needle bed (FNP) is mounted movingly onto the loom and in that said means (GL, EX, EX2, L1, L2) for moving act operationally also onto said second needle bed (FNP) and move it during the operation of the linear loom (TR2).

11. The loom according to claim 8, characterized in that said needle beds (FNA, FNP) can move parallel to the stroke of the corresponding needles (N).

12. The loom according to claim 8, characterized in that said needle beds (FNA, FNP) are basically vertical and parallel or basically horizontal and parallel.

13. The loom according to claim 8, characterized in that said moving needle beds (FNA, FNP) are mounted slidingly onto the loom (TR2) by means of at least a lateral guide (GL) fastened to a supporting frame of the loom (TR2).

14. The loom according to claim 8, characterized in that said means (GL, EX, Ex2, L1, L2) for moving the needle beds (FNA, FNP) comprise cams (EX, EX2) and/or levers (L1, L2), connecting rods and cranks, traction or return or compression springs, guides (GL) and/or sliding planes, slots and guiding pins inserted therein.

15. The loom according to claim 8, characterized in that said means (GL, EX, Ex2, L1, L2) for moving the needle beds (FNA, FNP) are connected to the general drive of the machine (TR2).

16. The loom according to claim 8, characterized in that said means (GL, EX, Ex2, L1, L2) for moving the needle beds (FNA, FNP) comprise a drive actuated by at least an electric motor connected to pushing, traction, torsion means, with direct, reduced, continuous, cyclical, controlled, gradual, micrometric movement.

* * * * *